US006880339B2

(12) United States Patent
Modi et al.

(10) Patent No.: US 6,880,339 B2
(45) Date of Patent: Apr. 19, 2005

(54) COMBINATION OF A PREMIXING CHAMBER AND A COMBUSTION CHAMBER, WITH LOW EMISSION OF POLLUTANTS, FOR GAS TURBINES RUNNING ON LIQUID AND/OR GAS FUEL

(75) Inventors: Roberto Modi, Florence (IT); Luciano Bonciani, Florence (IT); Gianni Ceccherini, Florence (IT)

(73) Assignee: Nuovo Pignone S.p.A., Florence (IT)

( * ) Notice: Subject to any disclaimer, the term of this patent is extended or adjusted under 35 U.S.C. 154(b) by 28 days.

(21) Appl. No.: 10/319,463

(22) Filed: Dec. 16, 2002

(65) Prior Publication Data

US 2005/0016177 A1 Jan. 27, 2005

(30) Foreign Application Priority Data

Dec. 21, 2001 (IT) ..... MI01A2781

(51) Int. Cl.[7] ..... F02C 1/00; F02C 3/00

(52) U.S. Cl. ..... 60/737; 60/746; 60/733; 60/39.463

(58) Field of Search ..... 60/737, 804, 746, 60/747, 733, 739, 740, 39.463, 742, 748; 431/285, 431/284, 287, 8

(56) References Cited

U.S. PATENT DOCUMENTS 5,351,477 A * 10/1994 Joshi et al. ..... 60/39.463
5,359,847 A * 11/1994 Pillsbury et al. ..... 60/39.463
5,408,825 A 4/1995 Foss et al.
5,623,819 A * 4/1997 Bowker et al. ..... 60/776
5,657,632 A * 8/1997 Foss ..... 60/742
5,660,044 A * 8/1997 Bonciani et al. ..... 60/737
6,019,596 A 2/2000 Knöpfel et al.
6,068,470 A * 5/2000 Zarzalis et al. ..... 431/187
6,422,858 B1 * 7/2002 Chung et al. ..... 431/8
6,513,334 B1 * 2/2003 Varney ..... 60/776
6,732,527 B1 * 5/2004 Freeman et al. ..... 60/737
2003/0118963 A1 * 6/2003 Modi et al. ..... 431/195
2003/0121266 A1 * 7/2003 Modi et al. ..... 60/740

FOREIGN PATENT DOCUMENTS

EP 0 589 520 3/1994
EP 0 670 456 9/1995
EP 1 070 915 1/2001

* cited by examiner

*Primary Examiner*—Cheryl J. Tyler
*Assistant Examiner*—William H. Rodriguez
(74) *Attorney, Agent, or Firm*—Nixon & Vanderhye

(57) ABSTRACT

An improved combination (110) of a premixing chamber (112) and a combustion chamber (111), with low emission of pollutants, for gas turbines running on liquid and/or gas fuel, in which the combustion chamber (111) has a truncated conical end (111*a*) and is surrounded by a cavity (115) for cooling air (120), the cavity (115) carrying combustion air (120*a*) to the premixing chamber (112), which has at its inlet apertures or ports (126) which can be constricted according to the quantity of fuel used, and at its outlet a circumferential set of burners (134) to create a corresponding set of additional flames; gas fuel supply means (125) fuel and liquid fuel injection devices (119) are provided in the premixing chamber (112), and a set of liquid fuel injectors (140) is present on the end (111*a*).

11 Claims, 3 Drawing Sheets

COMBINATION OF A PREMIXING CHAMBER AND A COMBUSTION CHAMBER, WITH LOW EMISSION OF POLLUTANTS, FOR GAS TURBINES RUNNING ON LIQUID AND/OR GAS FUEL

BACKGROUND OF THE INVENTION

The present invention relates to an improved combination of a premixing chamber and a combustion chamber, with low emission of pollutants, for gas turbines running on liquid and/or gas fuel.

As is known, a gas turbine is a machine consisting of a compressor and a turbine with one or more stages, in which these components are interconnected by a rotating shaft and in which a combustion chamber is provided between the compressor and the turbine.

Air from the external environment is supplied to the compressor for pressurization.

The pressurized air passes through a duct, terminating in a converging portion, into which a set of injectors supplies fuel which is mixed with the air to form a fuel-air mix for combustion.

The fuel required for the combustion process, which is designed to cause an increase in temperature and enthalpy of the gas, is supplied from a pressurized network and is introduced into the combustion chamber by means of one or more injectors.

A parallel fuel supply system, for generating pilot flames in the proximity of the outlet of the mixing duct, is also generally provided, in order to improve the stability characteristics of the flame.

Finally, the gas at high temperature and high pressure passes through suitable ducts to reach the various stages of the turbine, which converts the enthalpy of the gas to mechanical energy available for a user.

It is well known that, in the design of combustion chambers for gas turbines, the overriding considerations are those of flame stability and control of the excess air, the aim being to establish ideal conditions for the combustion process and minimize the output of pollutants.

A second element influencing the design of combustion chambers of gas turbines is the tendency to make combustion take place as near as possible to the dome of the combustion chamber.

More specifically, the prior art provides a combination of the premixing type, in other words one in which a premixing chamber is used and is located upstream from the combustion chamber and is separated from the latter by a constriction.

Both this premixing chamber and the combustion chamber are surrounded by a cavity containing pressurized air circulating in the opposite direction to the flow of combustion products leaving this combustion chamber.

This air is used as the combustion air to be mixed with the fuel in the premixing chamber and as the air for cooling both the combustion chamber and the combustion products.

Additionally, in the combination described above, the flow of the combustion air from the cavity to the premixing chamber, through apertures provided in the outer surface of the latter, can be constricted, in order to keep emissions of nitrogen oxide pollutants low at all levels of loading of the turbine.

The constriction is applied as a function of the quantity of fuel used, so that the ratio between the combustion air and the fuel constant is kept at the optimal value.

To prevent the flame from being extinguished or becoming unstable in any way, an annular set of holes is provided for an additional injection of fuel, so that the combustion region immediately downstream from the constriction is enriched with fuel.

In the prior art, one or more injectors are used, to enable liquid fuel to be used as an alternative to gas fuel or in a complementary way; these injectors produce diffusion flames and, owing to the lack of fuel and air mixing, cause high concentrations of polluting emissions.

At the present time, there is an increasing market demand for gas turbines which can run equally well on gas fuel and/or liquid fuel.

This flexibility must be provided without prejudice to the primary aim of reducing polluting emissions to a minimum, while also meeting other requirements for satisfactory combustion.

The object of the present invention is therefore to overcome the aforementioned drawbacks, and particularly to provide an improved combination of a premixing chamber and a combustion chamber for gas turbines running on liquid and/or gas fuel, which ensures a low emission of pollutants.

Another object of the present invention is to provide an improved combination of a premixing chamber and a combustion chamber, with low emission of pollutants, for gas turbines running on liquid and/or gas fuel which also provides good flame stability and reduces the oscillations of pressure in the combustion chamber.

Yet another object of the present invention is to provide an improved combination of a premixing chamber and a combustion chamber, with low emission of pollutants, for gas turbines running on liquid and/or gas fuel which provides a high combustion efficiency.

An additional object of the present invention is to provide an improved combination of a premixing chamber and a combustion chamber, with low emission of pollutants, for gas turbines running on liquid and/or gas fuel which can increase the average life of components subjected to high temperatures.

A further additional object of the present invention is to provide an improved combination of a premixing chamber and a combustion chamber, with low emission of pollutants, for gas turbines running on liquid and/or gas fuel which is particularly reliable, simple and functional, and whose production and maintenance costs are relatively low.

Advantageously, an improved combination of a premixing chamber and a combustion chamber, with low emission of pollutants, for gas turbines running on liquid and/or gas fuel according to the present invention can be made so that it is fairly easily interchangeable with combustion chambers according to the prior art which have already been installed.

BRIEF DESCRIPTION OF THE DRAWING FIGURES

The characteristics and advantages of an improved combination of a premixing chamber and a combustion chamber, with low emission of pollutants, for gas turbines running on liquid and/or gas fuel according to the present invention will be made clearer by the following description provided by way of example and without restrictive intent, with reference to the attached schematic drawings in which.

DETAILED DESCRIPTION OF THE PREFERRED EMBODIMENT

Figure 1:
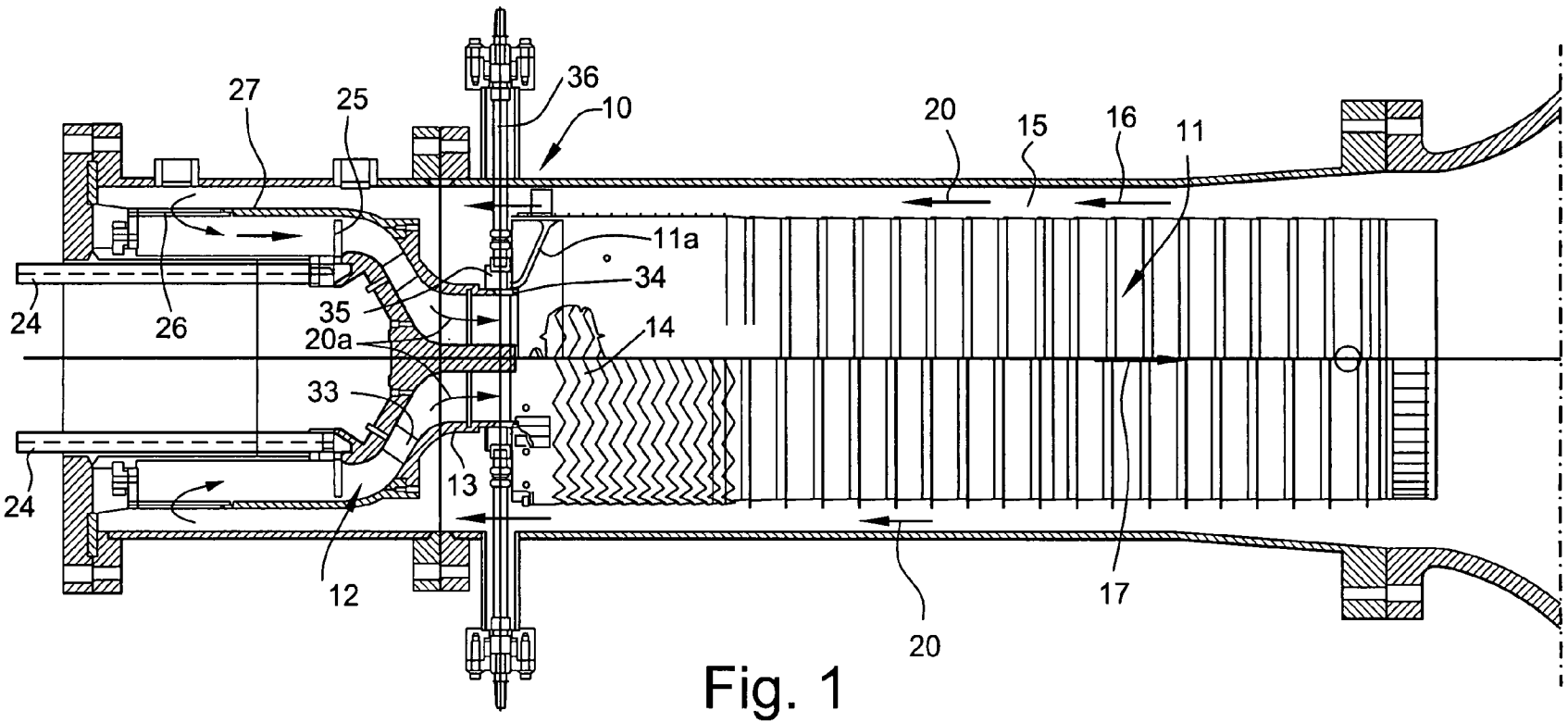
Fig. 1 (PRIOR ART)
FIG. 1 is a longitudinal view, in partial section, of a combination of a premixing chamber and a combustion chamber for gas turbines running on gas fuel according to the prior art.

With reference to FIG. 1, a combination, indicated as a whole by the number 10, of a premixing chamber 12 and a combustion chamber 11, with low emission of pollutants, for gas turbines running on gas fuel according to the prior art is shown.

In the illustrated example, the combustion chamber 11 has a truncated conical end 11*a* connected to the premixing chamber 12 by a constriction 13 immediately downstream from which there is the actual combustion region 14, in other words the primary flame region of the chamber 11.

The whole assembly is also surrounded by a cavity 15 for cooling air 20 which is pressurized by an axial compressor not shown in the figure, and which circulates in the direction of the arrow 16, in other words in the opposite direction to the flow 17 of the combustion products leaving the combustion chamber 11.

The premixing chamber 12 is also supplied with gas fuel by means of ducts 24 and a radial set of pierced tubes 25, while combustion air 20*a* is sent from the cavity 15 into the premixing chamber 12 through a set of apertures 26 provided in the casing 27 of the premixing chamber 12.

These apertures 26 interact with corresponding apertures in a drum which is rotatable on the casing 27. The drum, which is not shown in the figure, is rotated in such a way as to decrease the areas of the apertures 26 according to the quantity of fuel used.

Vanes 33 are also provided in the premixing chamber 12 and in the proximity of the constriction 13, to ensure that the flow passing through them travels in a specified direction, thus promoting the stabilization of the main flame.

Finally, a circumferential set of parallel burners 34 is fitted outside the constriction 13 in order to create a corresponding annular set of additional flames, concentric with the central main flame, in the combustion region 14, immediately downstream from the constriction 13.

The burners 34 are supplied with additional fuel through an annular chamber 35 and ducts 36, and also with combustion air.

Figure 2:
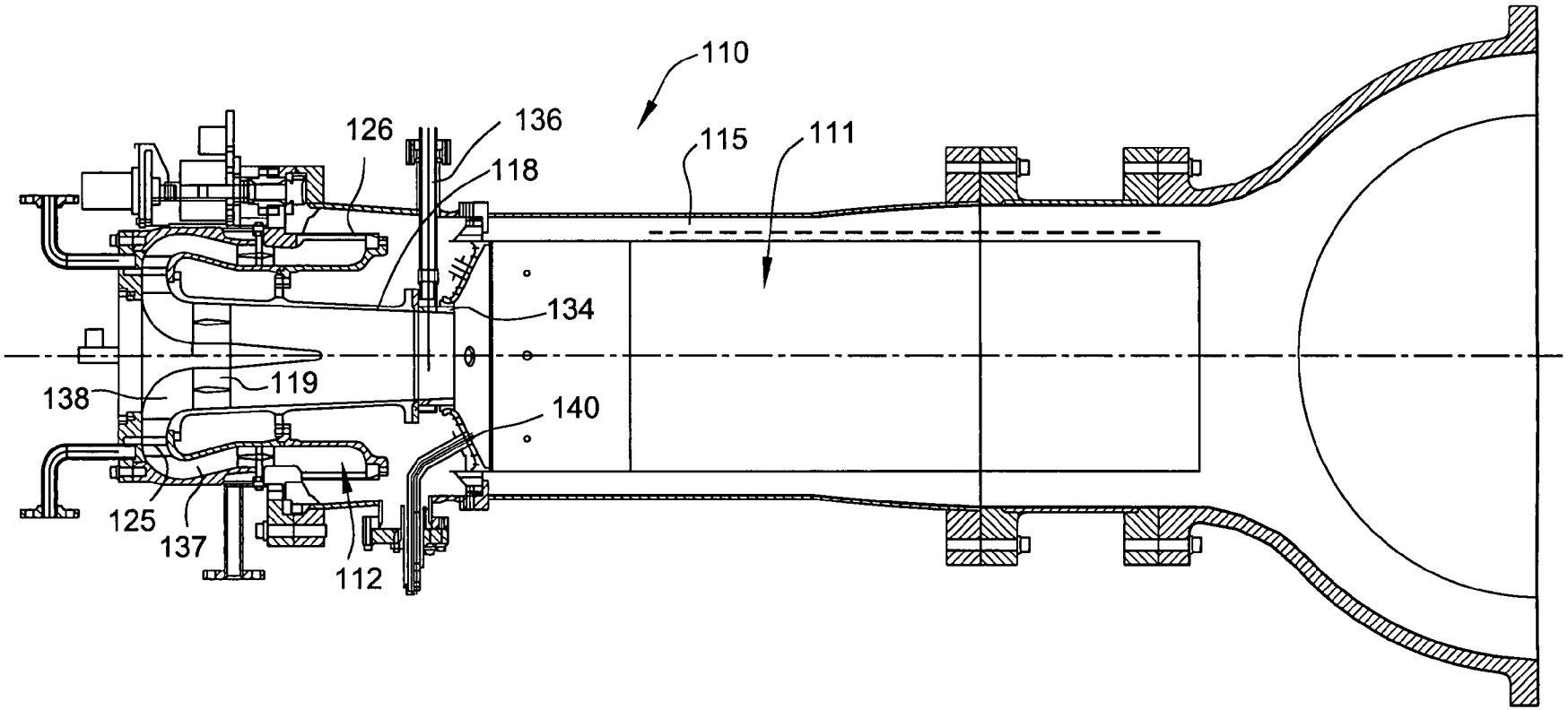
FIG. 2 shows a view in longitudinal section of a combination of a premixing chamber and a combustion chamber for gas turbines running on gas and/or liquid fuel according to the present invention.
Figure 3:
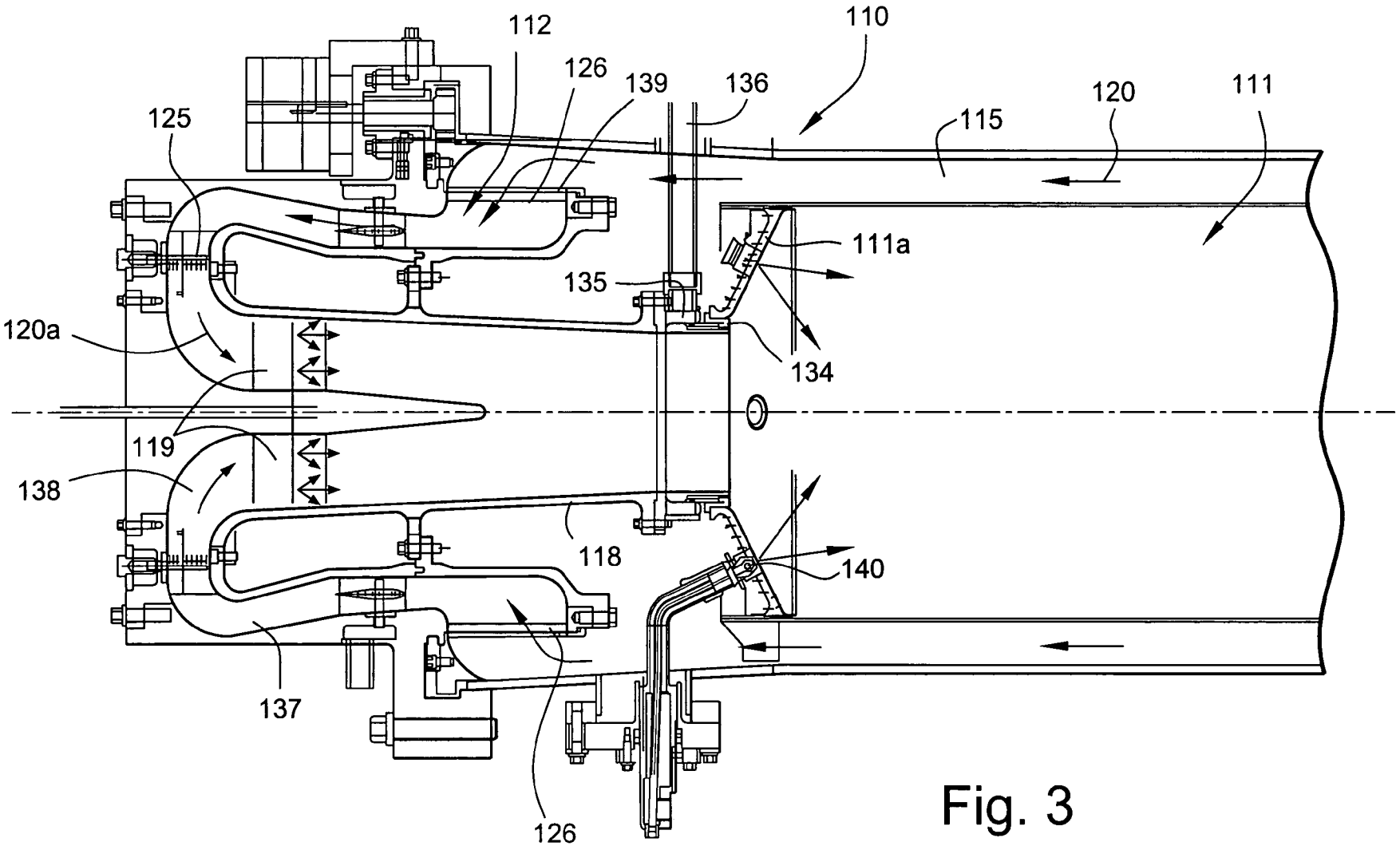
FIG. 3 shows an enlarged view in longitudinal section of a detail of FIG. 2.

FIGS. 2 and 3 show a combination, indicated in its entirety by the number 110, of a premixing chamber 112 and a combustion chamber 111, with low emission of pollutants, for gas turbines running on liquid and/or gas fuel according to the present invention, where components identical and/or equivalent to those shown in FIG. 1 with reference to the prior art have the same reference numbers, increased by 100.

In the illustrated example, the combustion chamber 111 has a truncated conical end 111*a* connected to the premixing chamber 112.

This premixing chamber 112 comprises a central structure 118, which is cylindrical, or slightly tapered in the form of a truncated cone, with a narrowing towards the combustion chamber 111, this structure having its axis coincident with that of the combustion chamber 111 and having within it a liquid fuel injection device 119, positioned axially, in the form of an annular structure for example.

The central structure 118 is connected downstream to the truncated conical end 111*a* of the combustion chamber 111, while it is joined upstream, by a connection 138 extending essentially perpendicularly to the axis of the premixing chamber 112 and therefore radially, to an annular chamber 137, which surrounds the central structure 118.

The end of the annular chamber 137 opposite that at which the annular chamber 137 is joined to the connection 138 has a circumferential set of apertures or ports 126, which are for example rectangular with axial extension, there being twelve of these apertures, which are spaced at equal intervals around a circumference.

These apertures 126 interact with corresponding apertures of a drum 139 which is rotatable on a portion of the annular chamber 137 where the apertures 126 are located.

The combustion chamber 111 is surrounded by a cavity 115 for cooling air 120 which is pressurized by an axial compressor (not shown in the figure) and which circulates in the direction of the arrow 116, in other words in the opposite direction to the flow 117 of the combustion products leaving the combustion chamber 111.

Combustion air 120*a* is sent from the cavity 115 to the apertures 126 of the annular chamber 137.

The premixing chamber 112 is also supplied with gas fuel through a circumferential set of supply means such as laterally pierced tubes 125, which for example have their axes parallel to the axis of the premixing chamber 112 and are located in the connection 138.

Downstream from the central structure 118 of the premixing chamber 112 there is fitted a circumferential set of burners 134, with their axes parallel to the axis of the premixing chamber 112 and directed towards the combustion chamber 111.

The burners 134 are supplied with additional gas fuel through an annular chamber 135 and ducts 136.

Finally, a set of injectors 140, numbering four for example, spaced at equal intervals around a circumference, and supplied with additional liquid fuel, is provided on the truncated conical end 111*a* and directed towards the interior of the combustion chamber 111.

The operation of the combination 110 of a premixing chamber 112 and a combustion chamber 111, with low emission of pollutants, for gas turbines running on liquid and/or gas fuel according to the invention is clear from what has been described above with reference to the figures, and is briefly as follows.

The cooling air 120 is pressurized by an axial compressor, not shown in the figures, and cools the combustion chamber 111.

As it cools the combustion chamber 111, the air 120 is heated and enters the annular chamber 137 of the premixing chamber 112 through the apertures 126, thus acting as the combustion air 120*a*.

The drum 139 is then rotated in such a way as to reduce the area of the apertures 126 according to the quantity of fuel used.

Gas fuel is added to this air 120*a* during its passage through the connection 138.

The injection device 119 supplies liquid fuel and thus creates the central primary combustion flame.

The circumferential set of burners 134 creates in the combustion chamber 111, immediately downstream from the truncated conical end 111*a*, a corresponding annular set of additional pilot flames, concentric with the central primary flame.

Finally, the set of injectors 140 supplies additional liquid fuel, with the aim of further stabilizing the combustion process.

The above description clearly indicates the characteristics of the improved combination of a premixing chamber and a combustion chamber, with low emission of pollutants, for gas turbines running on liquid and/or gas fuel, which is the object of the present invention, and also makes clear the corresponding advantages, which include:

- reduced levels of polluting emissions with both gas fuel and liquid fuel;
- reduced pressure oscillations in the combustion chamber and good flame stability;
- high combustion efficiency;
- increased average life of components subjected to high temperatures;
- simple and reliable operation;
- relatively low production and maintenance costs as compared with the prior art;
- good interchangeability with combustion chambers known in the prior art, and consequently fairly easy adaptability to gas turbines which have already been installed and which are to be renovated.

Finally, it is clear that the improved combination of a premixing chamber and a combustion chamber, with low emission of pollutants, for gas turbines running on liquid and/or gas fuel designed in this way can be modified and varied in numerous ways within the scope of the invention.

Additionally, all the components can be replaced with technically equivalent elements.

In practice, the materials used, as well as the shapes and dimensions, can be varied at will according to technical requirements.

The scope of protection of the invention is therefore delimited by the attached claims.

What is claimed is:

1. A combination of a premixing chamber and a combustion chamber, with low emission of pollutants, for gas turbines running on liquid and/or gas fuel, said combustion chamber having a truncated conical end, in the proximity of which a main central flame burns, and being surrounded by a cavity for cooling air circulating in the opposite direction to the flow of combustion products, said cavity carrying combustion air to said premixing chamber in which the combustion air is mixed with liquid and/or gas fuel, said premixing chamber having at an inlet thereto apertures or ports which can be constricted according to the quantity of fuel used, and having at an outlet thereto a circumferential set of burners directed towards said combustion chamber to create a corresponding set of additional flames concentric with said main central flame, said gas fuel supply means and liquid fuel injection devices being provided in the premixing chamber, and a set of liquid fuel injectors on the truncated conical end of said combustion chamber, said injectors being directed towards the interior of the combustion chamber.

2. A combination according to claim 1 wherein said premixing chamber comprises a central structure, which is cylindrical, or slightly tapered in the form of a truncated cone, with a narrowing towards the combustion chamber, the structure having its axis coincident with that of the said combustion chamber and having within it the said liquid fuel injection device which is positioned axially.

3. A combination according to claim 2, wherein said central structure is connected downstream to a truncated conical end of the combustion chamber and joined upstream, by a connection extending substantially perpendicular to the axis of the premixing chamber and therefore radially to an annular chamber, which surrounds the said central structure.

4. A combination according to claim 3, wherein said supply means comprises laterally pierced tubes which have their axes parallel to the axis of the premixing chamber and which are located in the connection.

5. A combination according to claim 1, wherein said burners have axes parallel to the axis of the premixing chamber.

6. A combination according to claim 1, wherein said burners are supplied with additional gas fuel through an annular chamber and ducts, and also with combustion air.

7. A combination according to claim 1, wherein the number of said liquid fuel injectors is four, said liquid fuel injectors being positioned at equal intervals around a circumference.

8. A combination according to claim 3, wherein said circumferential set of apertures is formed in said annular chamber, at the end opposite a juncture between the annular chamber and the connection.

9. A combination according to claim 8, wherein said apertures are rectangular, extend along the axis of the premixing chamber and are spaced at equal intervals around a circumference, the number of the apertures being twelve.

10. A combination according to claim 9, wherein said apertures interact with corresponding apertures of a drum rotatable on a portion of the annular chamber where the apertures of the premixing chamber are located.

11. A combination according to claim 1, wherein cooling air pressurized by an axial compressor flows through the said cavity.

* * * * *